United States Patent [19]

Illig et al.

[11] Patent Number: 4,709,912

[45] Date of Patent: Dec. 1, 1987

[54] APPARATUS FOR SEPARATING AND CONVEYING SHEET-LIKE ARTICLES

[75] Inventors: Egon Illig, Stuttgart; Volkmar Kniep, Esslingen, both of Fed. Rep. of Germany

[73] Assignee: Fraumhofer-Gesellschaft zur Förderung der angewandten Forschung e.v., Fed. Rep. of Germany

[21] Appl. No.: 839,047

[22] Filed: Mar. 12, 1986

[30] Foreign Application Priority Data

Mar. 12, 1985 [DE] Fed. Rep. of Germany ..... 3508737

[51] Int. Cl.[4] ..... B65H 3/24

[52] U.S. Cl. ..... 271/42; 221/259; 221/268; 91/402; 60/594

[58] Field of Search ..... 271/42, 97, 128–130, 271/18, 267, 33, 183; 221/76, 232, 268, 273, 274, 259, 210, 211, 212; 226/162–164, 158; 91/50, 402; 60/594; 414/117, 119

[56] References Cited

U.S. PATENT DOCUMENTS

| | | | |
|---|---|---|---|
| 1,230,070 | 6/1917 | Gottschalk | 91/402 |
| 2,208,299 | 7/1946 | Marcus | 91/402 |
| 2,467,740 | 4/1949 | Haller | 226/162 |
| 3,513,658 | 5/1970 | Okura | 60/594 |
| 3,910,567 | 10/1975 | Songer | 271/42 |
| 3,966,190 | 6/1976 | Grant | 271/42 |
| 4,167,239 | 9/1979 | Bihler | 226/162 |
| 4,290,593 | 9/1981 | Irvine | 271/42 |
| 4,591,140 | 5/1986 | Illig et al. | 271/107 |

FOREIGN PATENT DOCUMENTS

| | | | |
|---|---|---|---|
| 585677 | 11/1958 | Italy | 271/42 |
| 140442(A) | 11/1980 | Japan | 271/128 |
| 547513 | 8/1942 | United Kingdom | 271/42 |

*Primary Examiner*—H. Grant Skaggs

*Attorney, Agent, or Firm*—Jones, Tullar & Cooper

[57] ABSTRACT

In order to accomplish the separation and further conveyance of the uppermost sheet of a stack of sheets by the simplest possible means, an elastic friction finger resting with slight pressure on the uppermost sheet of the stack is provided, which is set into reciprocating motion in a direction (A-B) that is inclined by a certain angle ($\alpha$) relative to the surface of the stack, the movement having a low amplitude and a relatively high frequency. The stack itself is inclined backward relative to the horizontal by a certain angle ($\beta$). The drive of the friction finger may be effected by means of a bellows connected to a valveless pump, by a pneumatic cylinder, or by a crank drive. It is also possible to connect a pneumatic cylinder, provided with vent bores controlled by the piston, to a supply line that is at constant negative pressure or overpressure.

16 Claims, 6 Drawing Figures

APPARATUS FOR SEPARATING AND CONVEYING SHEET-LIKE ARTICLES

CROSS-REFERENCE TO RELATED APPLICATION

This application discloses subject matter which relates to subject matter disclosed in co-pending application, Ser. No. 839,048.

FIELD OF THE INVENTION

The invention relates to an apparatus for separating and conveying sheet-like articles, in which the uppermost sheet of a stack of sheets has a friction element resting on it that is moved periodically back and forth.

OBJECT AND SUMMARY OF THE INVENTION

It is an object of the invention to improve an apparatus of this type in such a manner that the separation and further conveyance of the uppermost sheet of a stack of sheets can be reliably accomplished by the simplest possible means. In particular, it should be possible to dispense with special retaining means for the next sheets in the stack of sheets as well as to dispense with switch-over means for driving the friction element, such as free wheels or the like.

Details of the invention will become apparent from the dependent claims and from the ensuing description of various exemplary embodiments, taken in conjunction with the drawings.

DESCRIPTION OF THE PREFERRED EMBODIMENTS

Figure 1:
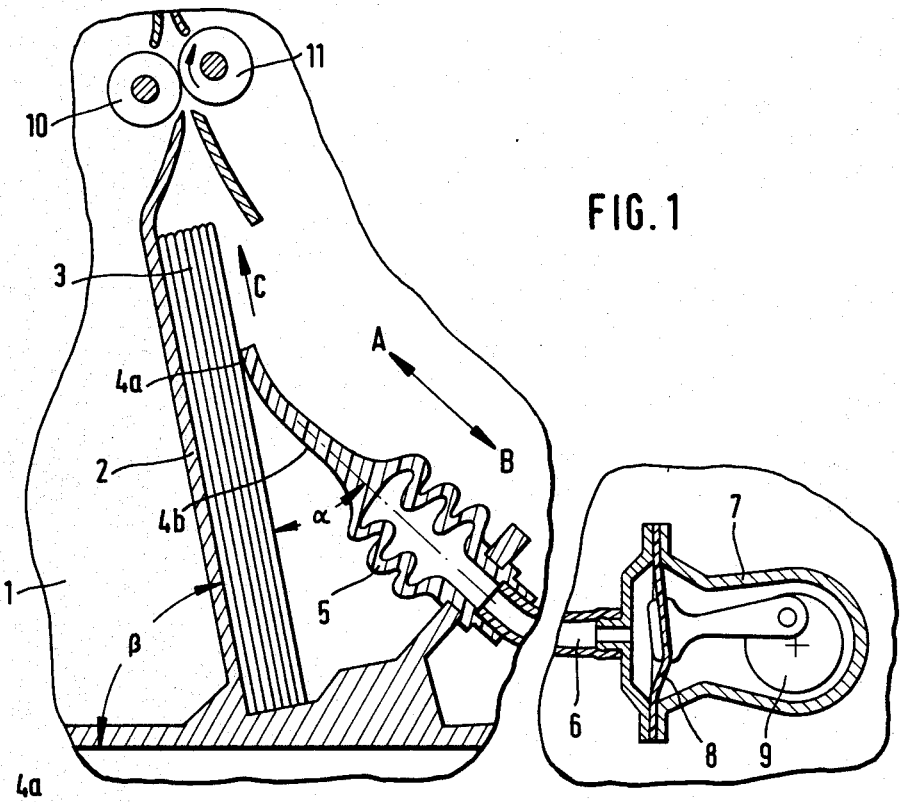
FIG. 1 is a section taken through a separating apparatus according to the invention, in which the friction finger is secured to a flexible bellows.

A shown in FIG. 1, a stacking table 2, inclined by an angle ($\beta$) of approximately 80° from the horizontal, is disposed on a frame for the apparatus, supporting a stack 3 of sheets. The sheet stack 3 rests by its own weight with its rearward edge on a rear stack stop 2*a*. An elastic bellows 5 is disposed above the sheet stack 3, and an elastic friction finger 4 is secured on the bellows 5. The friction finger 4 rests on the surface of the stack 3 of sheets with slight pressure, under the influence of which the friction finger undergoes a slight flexure.

The bellows 5 is connected by means of a connecting line 6 to a valveless pump 7. The pump 7 is embodied as a diaphragm pump, the diaphragm 8 of which is driven by means of an eccentric element that rotates in the direction of the arrow D. The pump 7 generates a periodically changing overpressure and negative pressure in the connection line 6, under the influence of which the bellows 5 expands and then contracts again in rapid succession. As a result, the friction finger 4 secured to the bellows 5 is made to execute a periodic reciprocating movement in the direction of the arrow A-B, that is inclined by an angle of approximately 30° to 40° from the surface of the stack 3 of sheets. Upon each forward movement in the direction of the arrow A, the friction finger 4 is pressed to a greater extent against the surface of the stack 3 of sheets, and its forward edge 4*a* then also presses to a greater extent into the uppermost sheet of the stack. Upon each rearward movement in the direction of the arrow B, the pressing force of the friction finger 4 decreases, and its smooth underside 4*b*, which is inclined at an acute angle with respect to the surface of the stack, slides relatively easily back over the surface of the stack. By means of this alternation of the forces acting upon the uppermost sheet of a stack during the periodic movement of the friction finger 4, a driving force that is exerted in the direction of the arrow C upon the uppermost sheet of the stack is brought about, which delivers the sheet to a pair of conveyor rollers, 10, 11 driven either continuously or in synchronism with a following machine.

In the course of the separating and conveying operation, the next sheet of the stack at a given time is held back, first by the force of gravity exerted upon the sheets of the stack, which is inclined by an angle ($\beta$) from the horizontal. Furthermore, the forces of inertia engaging the sheet also contribute to the reliable separation of the sheet, and these forces arise in particular if the amplitude of movement of the friction finger in the direction A-B is relatively small and the frequency of this movement is relatively high. Good results have been attained with an amplitude of a few millimeters and a vibrational frequency of 10 to 100 Hz, preferably 50 Hz.

Figure 2:
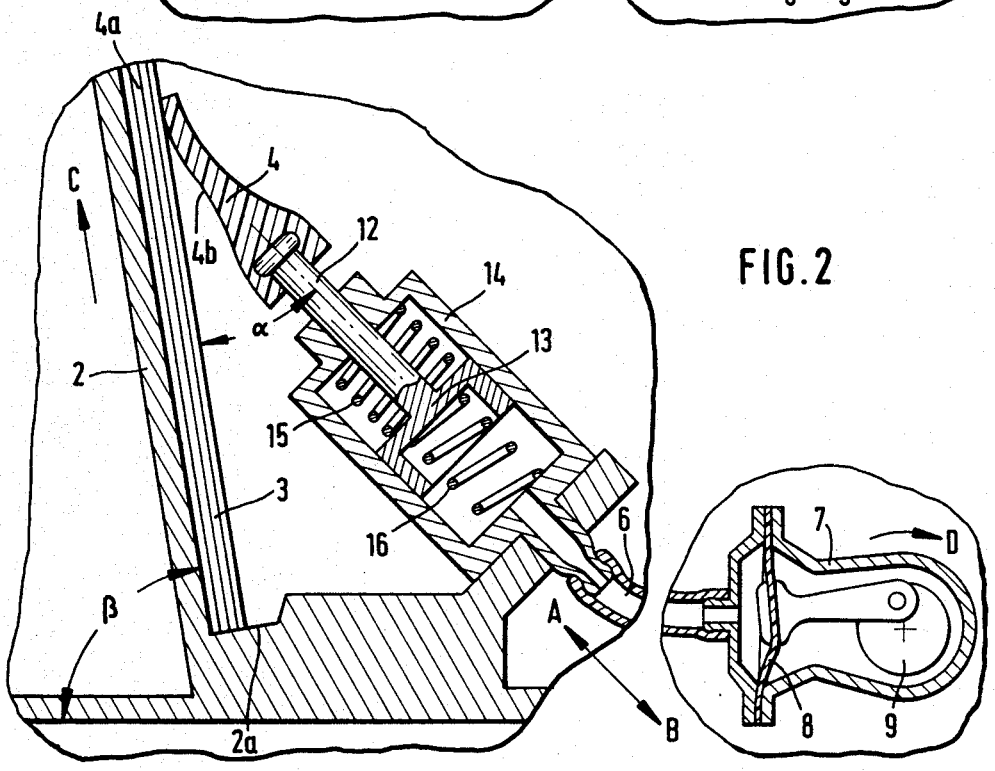
FIGS. 2 and 3 show a friction finger driven by a pneumatic cylinder.

As shown in FIG. 2, the friction finger 4 is secured on a piston rod 12, which is connected to a piston 13 supported in a cylinder 14. The piston 13 is engaged by compression springs 15 and 16 acting in opposite directions from one another, which retain the piston 13 in a balanced outset position located approximately in the middle of the cylinder. Under the influence of the pump 7 connected to the cylinder 14 by means of the connecting line 6, the piston 13 executes reciprocating movements about this initial position, and these movements impart a periodic driving movement in the direction of the arrows A-B to the piston rod 12 and to the friction finger 4 secured on it.

Figure 3:
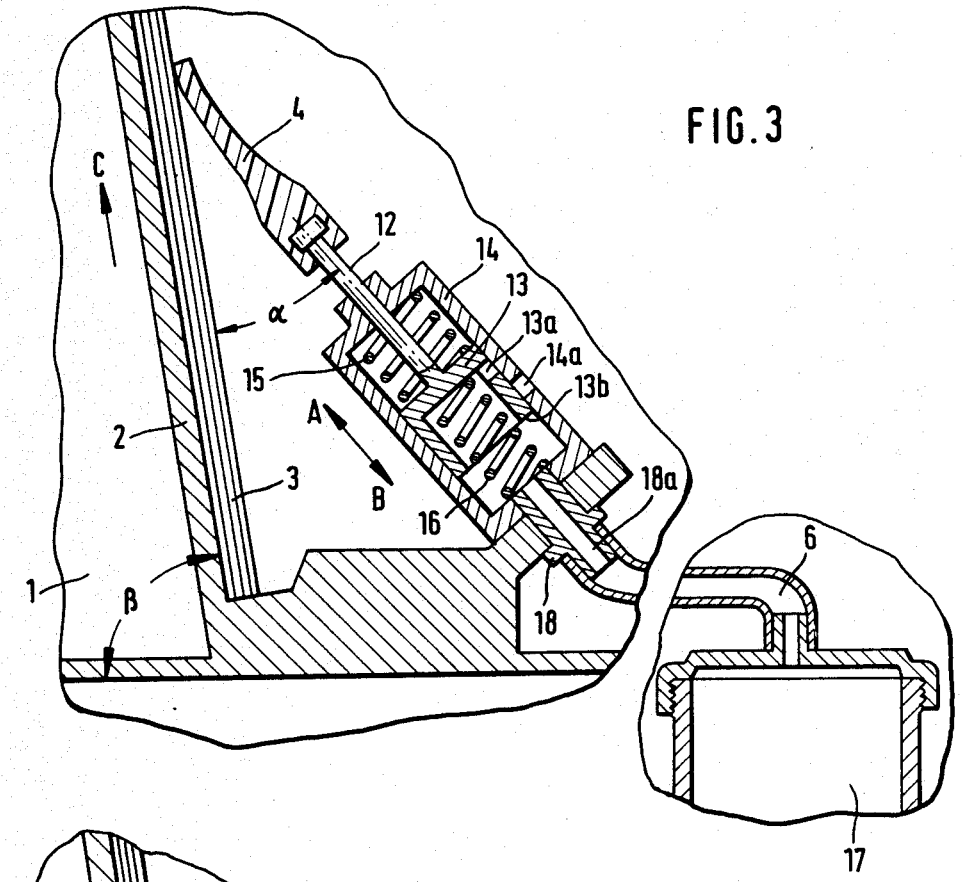

In FIG. 3, the connecting line 6 of the cylinder 14 is connected to an air tank 17, which in a known manner is maintained at a substantially constant negative pressure or over pressure by means of a feed pump (not shown in detail in the drawing) and controlled by a pressure sensor. The periodic movement of the piston 13 or of the friction finger 4 connected to the piston arises in this case because the piston 13 initially, under the influence of the overpressure or negative pressure operative in the connecting line 6, moves out of its initial position dictated by the springs 15 and 16, causing the control slit 13*a* or the rearward piston edge 13*b* to uncover a vent opening 14*a* provided in the cylinder wall. The vent opening 14*a* has a larger cross section than the bore 18*a* of the connecting pipe 18 that connects the cylinder 14 to the connecting line 6. The bore 18 thereby acts as a throttle located in the connecting line, and this throttle, upon the uncovering of the vent opening 14*a*, causes an abrupt pressure drop in the cylinder 14. As a result, the piston 13 swings back and the vent bore 14*a* closes once again, until a pressure difference sufficient to open the vent bore has once again built up in the cylinder by means of the bore 18*a*.

In this manner, the piston 13 and the friction finger 4 secured to it are set into reciprocating motion in the direction of the arrow A-B, the frequency of this motion being dependent on the overpressure or negative pressure prevailing in the connecting line, on the restoring forces and forces of inertia engaging the piston and on the throttling effect of the throttle located in the connecting line. By suitable selection of the above parameters, the frequency required for the periodic reciprocation of the friction finger can readily be established.

Figure 4:
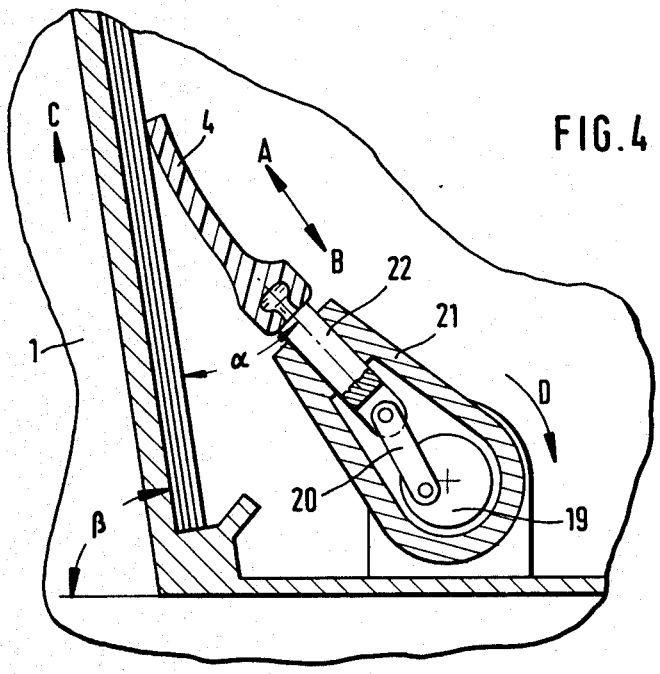
FIG. 4 shows a friction finger that is moved by means of a crank drive.

In FIG. 4, an eccentric element 19 that rotates in the direction of the arrow D is joined by means of a crank rod 20 to a push rod 22 supported in a longitudinally displacable manner in a housing 21, as a result of which the friction finger 4 secured to the push rod is set into periodic motion in the direction of the arrows A-B.

Figure 5:
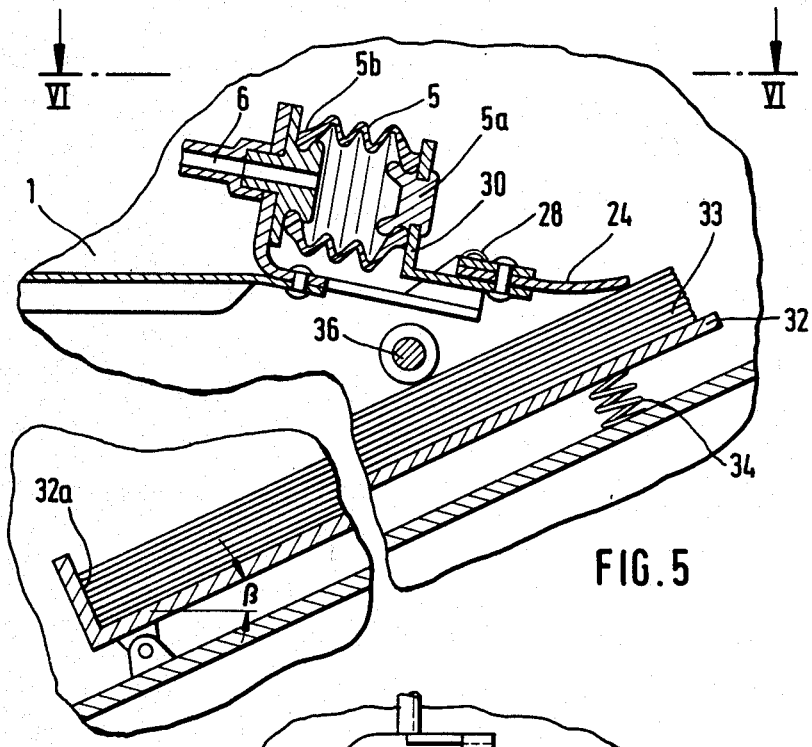
FIGS. 5 and 6 show a resiliently suspended friction finger.
Figure 6:
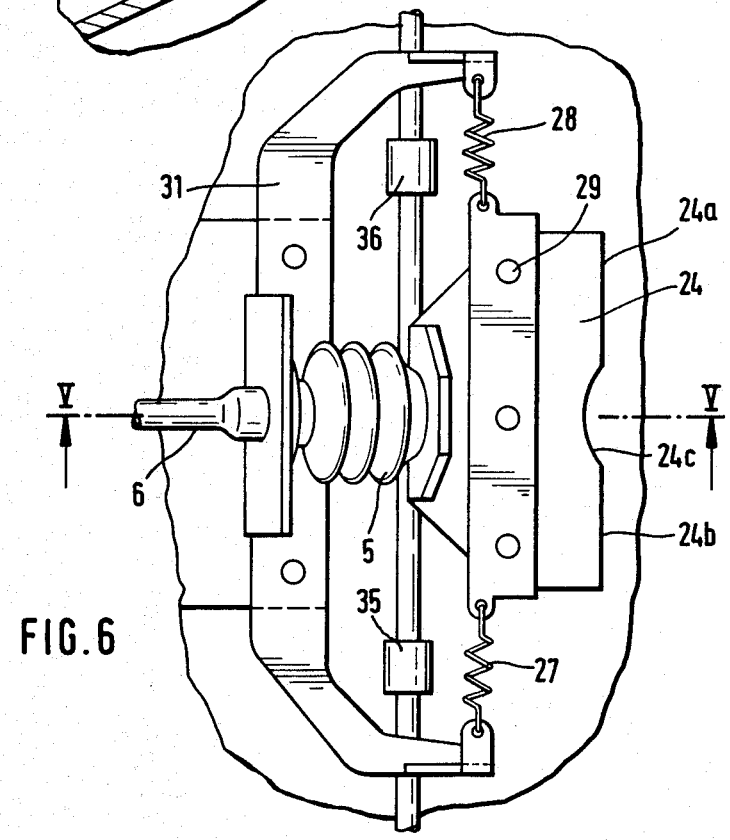

As shown in FIGS. 5 and 6, a relatively wide friction finger 24 is suspended between tension springs 27 and 28. The friction finger 24 has a recess **24*c* on its front edge, dividing this front edge into two edge portions 24*a* and 24*b*. The division of the friction finger edge into two separate portions counteracts tilting of the separated sheet while the sheet is being conveyed to the pair of conveyor rollers 10, 11**.

The friction finger 24 is secured by means of rivets 29 to a holder 30, which is connected to one end **5*a* to a bellows 5. The other end 5*b* of the bellows is affixed to a supporting bracket 31 attached to the frame, and this supporting bracket also serves to suspend the tension springs 27 and 28**.

The stacking table 32 is pivotable in a known manner in order to compensate for the decreasing height of the stack 33 over the course of the separation process. The stacking table 32 is pressed by means of a compression spring 34 against non-driven stop rollers 35, 36 supported such that they are attached to the apparatus. The result is an inclined position of the stack of sheets, that is, inclined by an angle of approximately 30° from the horizontal, and the rear edge of the stack again rests on a rearward stack stop **32*a***.

What is claimed is:

1. An apparatus for separating and transporting sheet-like articles from a stack of sheet-like articles, comprising:

a stacking table for holding the stack of sheet-like articles and defining a transport direction into which the sheet-like articles are to be transported from the stack;

a pair of conveyor rollers arranged at a predetermined distance from the stack in the transport direction for conveying the sheet-like articles further in the transport direction;

continuously reciprocating drive means for generating a reciprocating movement in a predetermined direction toward and away from the stack, said predetermined direction being inclined with respect to the transport direction by a predetermined angle; and a friction element attached at one end to the drive means and extending away from the drive means in said predetermined direction, said friction element including at its other end an elastic portion which can be flexed elastically away from said predetermined direction, said elastic portion being arranged to impinge on the uppermost one of the sheet-like articles at least during a part of that portion of the reciprocating movement directed toward the stack thereby bending said elastic portion and increasing the pressure exerted by said elastic portion on the uppermost one of the sheet-like articles, and to be straightened at least during a part of that portion of the reciprocating movement directed away from the stack thereby decreasing the pressure exerted on the uppermost one of the sheet-like articles.

2. The apparatus as defined in claim 1, wherein:

the angle of inclination of the predetermined direction with respect to the transfer direction ranges from 10°-60°; and the transport direction is inclined at an angle of inclination to the horizontal which ranges from 20°-80°.

3. The apparatus as defined in claim 2, further wherein:

the angle of inclination is 30°.

4. The apparatus as defined in claim 2, further wherein:

the angle of inclination of the stack of sheets is 45°.

5. The apparatus as defined in claim 1, wherein:

each sheet defines a removal movement; and the amplitude of the reciprocating movement is less than the removal movement of a sheet.

6. The apparatus as defined in claim 5, further wherein:

the frequency of the reciprocating movement is 10 to 100 Hz.

7. The apparatus as defined in claim 5, further wherein:

the frequency of the reciprocating movement is 50 Hz.

8. The apparatus as defined in claim 1, wherein:

the drive means includes a valveless pump; and the friction element further includes a flexible bellows secured to the elastic portion, said flexible bellows being connected to the valveless pump.

9. The apparatus as defined in claim 1, further comprising:

a spring disposed on each lateral side of the elastic portion and wherein:

the elastic portion is suspended between the springs.

10. The apparatus as defined in claim 1, wherein:

the means for reciprocating the friction element includes a pneumatic cylinder which defines the direction of movement of the elastic portion.

11. The apparatus as defined in claim 10, further wherein:

the pneumatic cylinder includes a piston; and the means for reciprocating the friction element includes two compression springs situated in the pneumatic cylinder and serving therein to maintain the piston in the pneumatic cylinder in a central piston.

12. The apparatus as defined in claim 11, further wherein:

the means for reciprocating the friction element further includes a pressure source connected to the pneumatic cylinder; and the pneumatic cylinder includes at least one vent slit disposed in the cylinder wall of the pneumatic cylinder at a location such that they are covered by the piston when said piston is in its central position and open to communicate the pressure source to ambient air during the reciprocating movement.

13. The apparatus as defined in claim 12, further wherein:

the pressure source supplies compressed air.

14. The apparatus as defined in claim 12, further wherein:

the pressure sources supplies a vacuum.

15. The apparatus as defined in claim 1, wherein:

the means for reciprocating the friction element comprises a crank mechanism.

16. An apparatus for separating sheet-like articles from a stack of sheet-like articles, comprising:

a friction element including an elastic portion, one end of which is flexed in pressure engagement with the uppermost sheet of a stack of sheets, and a flexible bellows secured to the elastic portion; and a valveless pump for reciprocating the friction element relative to the stack of sheets, wherein:

the stack of sheets is inclined at an angle to the horizontal, and each sheet defines a planar surface;

the direction of reciprocation is inclined at an angle to the planar surface of the sheets of the stack of sheets; and the flexible bellows is connected to the valveless pump.

* * * * *